US007207900B2

(12) United States Patent
Nicolette et al.

(10) Patent No.: US 7,207,900 B2
(45) Date of Patent: Apr. 24, 2007

(54) GOLF CLUB HEAD WEIGHT ADJUSTMENT MEMBER

(75) Inventors: Michael R. Nicolette, Scottsdale, AZ (US); Ricky A. Solesbee, Glendale, AZ (US); Leslie J. Bryant, Peoria, AZ (US); John A. Solheim, Phoenix, AZ (US); Bradley D. Schweigert, Anthem, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 10/909,041

(22) Filed: Jul. 29, 2004

(65) Prior Publication Data

US 2006/0025234 A1 Feb. 2, 2006

(51) Int. Cl.
*A63B 53/04* (2006.01)

(52) U.S. Cl. ..... 473/334; 473/349; 473/350

(58) Field of Classification Search ..... 473/334–350, 473/287–292; D21/736–752; 301/5.21
See application file for complete search history.

(56) References Cited

U.S. PATENT DOCUMENTS

| | | | | | |
|---|---|---|---|---|---|
| D225,123 | S | * | 11/1972 | Viero | D21/749 |
| 3,995,858 | A | * | 12/1976 | Cochran et al. | 473/291 |
| 4,300,803 | A | * | 11/1981 | Chorosevic | 301/5.21 |
| 4,326,326 | A | * | 4/1982 | MacDonald | 29/428 |
| D268,856 | S | * | 5/1983 | Fisher | D21/749 |
| D279,022 | S | * | 5/1985 | Worster et al. | D21/749 |
| 5,082,278 | A | * | 1/1992 | Hsien | 473/242 |
| 5,344,151 | A | * | 9/1994 | Anderson et al. | 473/337 |
| 5,385,348 | A | * | 1/1995 | Wargo | 473/338 |
| 5,590,881 | A | * | 1/1997 | Jernigan | 473/324 |
| 5,658,208 | A | * | 8/1997 | Shimasaki | 473/349 |
| 5,833,551 | A | * | 11/1998 | Vincent et al. | 473/350 |
| 6,077,173 | A | * | 6/2000 | Stites | 473/334 |
| 6,206,790 | B1 | | 3/2001 | Kubica | |
| 6,290,609 | B1 | * | 9/2001 | Takeda | 473/335 |
| 6,406,382 | B1 | * | 6/2002 | Deshmukh et al. | 473/349 |
| D473,605 | S | * | 4/2003 | Petersen et al. | D21/747 |
| D481,775 | S | * | 11/2003 | Best | D21/759 |
| 6,695,714 | B1 | | 2/2004 | Bliss | |
| D492,376 | S | | 6/2004 | Nicolette | |
| D500,350 | S | | 12/2004 | Schweigert | |
| D500,351 | S | | 12/2004 | Schweigert | |
| 6,849,005 | B2 | * | 2/2005 | Rife | 473/350 |
| D503,204 | S | | 3/2005 | Nicolette | |
| D504,925 | S | | 5/2005 | Schweigert | |

* cited by examiner

*Primary Examiner*—Sebastiano Passaniti
(74) *Attorney, Agent, or Firm*—Darrell F. Marquette

(57) ABSTRACT

The present invention relates to certain weight adjustment members that can be used in connection with iron-type golf clubs. The weight adjustment members of the present invention comprise a relatively uniform and/or symmetrically configured width. In addition, the members comprise a substantially linear back-side. The weight adjustment members of the present invention, therefore, provide a consistent level of performance across the members and, moreover, can be mass produced using more simplified molds when compared to other members known in the art. Still further, the present invention provides iron-type golf heads and golf clubs that comprise the weight adjustment members of the present invention.

1 Claim, 4 Drawing Sheets

GOLF CLUB HEAD WEIGHT ADJUSTMENT MEMBER

FIELD OF THE INVENTION

The present invention relates generally to golf equipment and, in particular, to weight adjustment members for iron-type golf club heads.

BACKGROUND OF THE INVENTION

Golf club designers and manufacturers have found that weight adjustment members can be employed to optimize certain characteristics of golf clubs. In particular, weight adjustment members can be used to, among other things, affect the weight of the club, adjust and compensate for variations in manufacturing tolerances, adjust the "feel" of a club, and adjust and enhance vibration characteristics of a golf club. U.S. Pat. No. 6,206,790 to D. J. Kubica et al discloses a representative weight adjustment member for iron-type golf clubs.

The weight adjustment member disclosed in U.S. Pat. No. 6,206,790 is shown to be disposed in a secondary cavity, which is located within a primary cavity that forms the back-side of the club. The weight adjustment member is further described to have a predetermined volume, which may have a plurality of different weights and densities to achieve different attributes.

The soles of many iron-type golf clubs progressively increase in width from heel to toe. That is, the soles of iron-type golf clubs are, typically, greater in width near the toe of the club than near the heel. This design serves many functions including, for example, it helps to prevent unwanted twisting movement about a vertical axis through the body of the golf club head, which may otherwise result when the front face of the club impacts a ball near the toe or heel portions.

Accordingly, some weight adjustment members known in the art have been designed to accommodate the progressive width characteristics of the soles of such iron-type club heads. For example, weight adjustment members have been designed to proportionately increase in width from the portion near the heel-end of the club to the portion near the toe-end of the club. Of course, designing a weight adjustment member in this manner allows the exterior side of the member to remain substantially adjacent to the back-side of the sole as it also increases in width from heel to toe. In this prior art design, however, the depth of the cavity into which the member is disposed in the back-side of the club, preferably, also increases from heel to toe, which is generally required to maintain a relatively constant distance between the member and club face.

Still further, weight adjustment members have been designed with convex, angled backs to accommodate golf club soles with progressive widths. In such case, the cavity into which the member is disposed in the back-side of the club head, preferably, exhibits a complementarily angled, concave surface to receive the member. When this design is employed, the member can be positioned in such a way that allows the exterior surface of the member to remain substantially adjacent to the back-side of the sole as it increases in width from heel to toe.

Of course, the foregoing designs for weight adjustment members require fairly sophisticated molds and manufacturing processes to, for example, create the variability in width and/or angled backs in the members, and, further, may require complex forging or casting procedures to create appropriately configured corresponding cavities in the back-side of golf club heads. Additionally, in some cases, such designs may result in performance differences across the member in light of potential variation in width of the member and/or distance from the club face.

In light of the foregoing, the inventors have discovered certain novel weight adjustment members, which exhibit a substantially linear back-side and a relatively uniform width from the heel to toe portion. In further embodiments of the present invention, the inventors have developed novel weight adjustment members, which exhibit a substantially linear back-side and a symmetrically configured variable width. The inventors have discovered that the weight adjustment members of the present invention may be disposed in a cavity, which is oriented in the back-side of a club head as described herein, to allow the exterior face (a.k.a. the exterior surface) of the member to remain substantially adjacent (or symmetrically aligned) with the surface of the back-side of iron-type clubs from heel to toe.

Because the weight adjustment members of the present invention exhibit (i) a relatively uniform or symmetrically configured width and/or (ii) a substantially linear back-side, the members simplify the methods and molds that are needed to manufacture the same and, of course, the club heads with which such members may be used. The approximately uniform or symmetrically configured width provides a more consistent level of performance across the weight adjustment member and, furthermore, may allow the member to comprise a greater volume.

In still further embodiments of the present invention, novel golf club heads are provided, which comprise at least one cavity in the back-side of the club head, wherein the cavity is approximately equal distance from the club face from its heel- to toe-end. The golf club heads of the present invention, preferably, may be used in connection with at least one weight adjustment member of the present invention.

SUMMARY OF THE INVENTION

According to one aspect of the present invention, weight adjustment members adapted for iron-type golf clubs are provided. The weight adjustment members comprise a substantially linear back-side, which are disposed within a cavity in the back-side of iron-type golf clubs. In certain, preferred embodiments, the primary longitudinal axis of the cavity is angled upward from the sole axis at least to the point where the exterior face of the weight adjustment members, when disposed in such cavity, are approximately adjacent to the back-side of the iron-type golf clubs. The exterior face may be substantially linear or, alternatively, symmetrically configured. When the exterior face of the member is symmetrically configured, of course, its relative adjacency to the back-side of the club head may vary from its heel- to toe-end.

The weight adjustment members of the present invention may be used in connection with a plurality of iron-type golf clubs including, but not limited to, "cavity-backed" clubs, "blade-type" clubs, and clubs exhibiting characteristics of "cavity-backed" and "blade-type" clubs. Still further, the present invention may be used in other iron-type golf clubs, which comprise the weight adjustment members of the present invention.

The present invention further provides novel golf club heads, which comprise at least one cavity in the back-side of the club head, wherein the cavity is approximately equal distance from the club face from its heel-to toe-end. The golf club heads of the present invention, preferably, may be used in connection with at least one weight adjustment member of the present invention.

The above-mentioned and additional features of the present invention are further illustrated in the Detailed Description contained herein. All references disclosed herein, including U.S. patents, are hereby incorporated by reference in their entirety as if each was incorporated individually.

DESCRIPTION OF THE INVENTION

Figure 1:
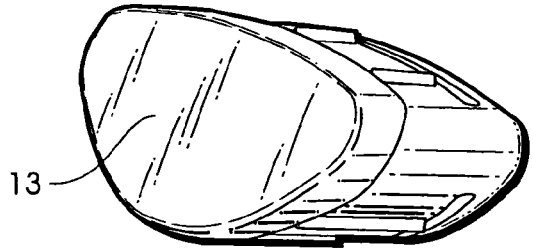
FIG. 1 is a perspective view of a weight adjustment member of the present invention.
Figure 2:
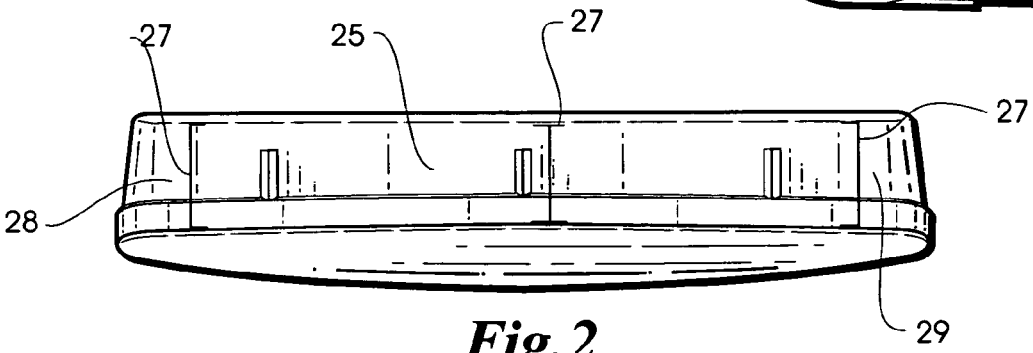
FIG. 2 is a front elevational view of the weight adjustment member shown in FIG. 1.
Figure 3:
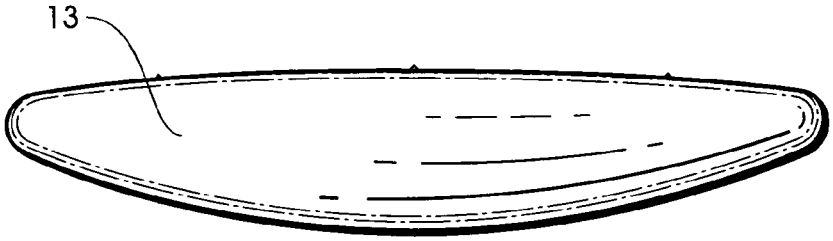
FIG. 3 is a front view of the weight adjustment member shown in FIG. 1.
Figure 4:
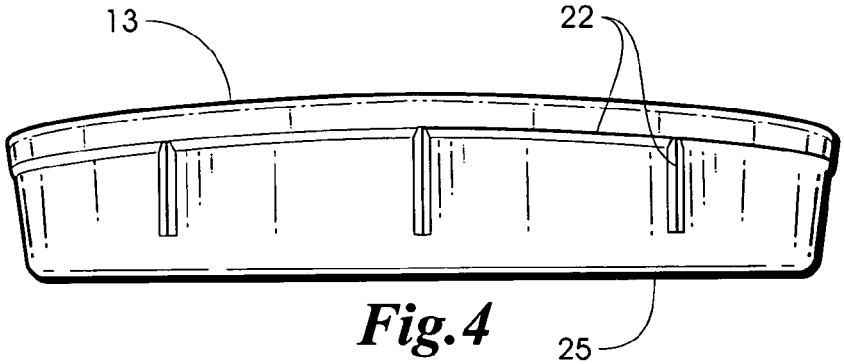
FIG. 4 is a bottom view of the weight adjustment member shown in FIG. 1.
Figure 5:
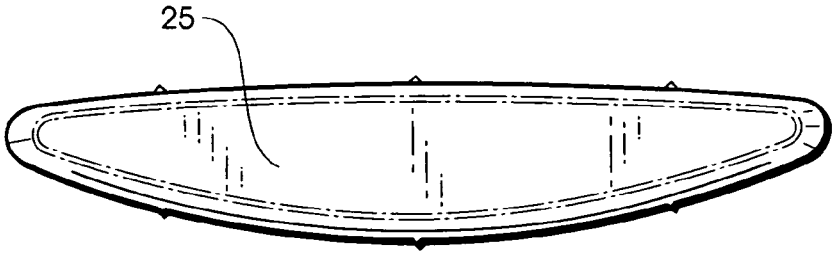
FIG. 5 is a back-side view of the weight adjustment member shown in FIG. 1.

The following will describe in detail several preferred embodiments of the present invention. These embodiments are provided by way of explanation only, and thus, should not unduly restrict the scope of the invention. In fact, those of ordinary skill in the art will appreciate upon reading the present specification and viewing the present drawings that the invention teaches many variations and modifications, and that numerous variations of the invention may be employed, used and made without departing from the scope and spirit of the invention.

The present invention provides weight adjustment members adapted for iron-type golf clubs. Referring to FIGS. 8–11, an iron-type golf club head 1 includes a body 2 and a hosel 3 for receiving one end of a shaft (not shown). The body 2 has a heel-end 4 and a toe-end 5. The club head 2 has a front face 6 arranged for impact with a golf ball, which extends between the heel- and toe-ends 4, 5. The front-side 6 (a.k.a. the front face) is, preferably, provided with a plurality of grooves, which are positioned to make contact with a golf ball (not shown).

In addition, the club head 1 has a back-side 7 opposite the front-side 6. The back-side of the club head in the present invention can, optionally, comprise a primary cavity, which is shown and described in U.S. Pat. No. 6,206,790 to D. J. Kubica et al. Golf clubs that employ a primary cavity in the back-side of the club head, i.e. "cavity-backed" golf clubs, have become incredibly popular over the years among golfers of all skill levels. "Cavity-backed" golf clubs, generally, are known to minimize the unwanted effects of "mis-hits," which occur when the front-side of the club impacts a ball near the toe or heel portions. See U.S. Pat. No. 4,621,813 to K. Solheim.

In many "cavity-backed" golf club heads known in the art, the primary cavity is formed by what is commonly referred to as a perimeter weighting element. The perimeter weighting element, preferably, protrudes rearwardly away from the front face of the club head, which defines the primary cavity in the back-side of the club head. The perimeter weighting element, typically, includes a top rail and a bottom rail. The primary cavity, therefore, when a golf club is positioned to address a golf ball, is defined at its upper extremity by the top rail and at its lower extremity by the sole. The top rail extends between the body heel and toe portions along an upper portion of the body, whereas the sole extends between the body heel and toe portions along the lower portion of the body.

Alternatively, the back-side of the golf club of the present invention may comprise a "blade-type" design. Golf club heads exhibiting "blade-type" designs, typically, comprise a back-side that is either solid or lacks a defined cavity. That is, the back-side of "blade-type" iron heads do not exhibit significant perimeter weighting elements, which protrude rearwardly from the club head as in "cavity-backed" club heads. Still further, the back-side of the club heads useful in the present invention may, optionally, comprise a design that embodies characteristics of both "cavity-backed" and "blade-type" club heads.

Figure 9:
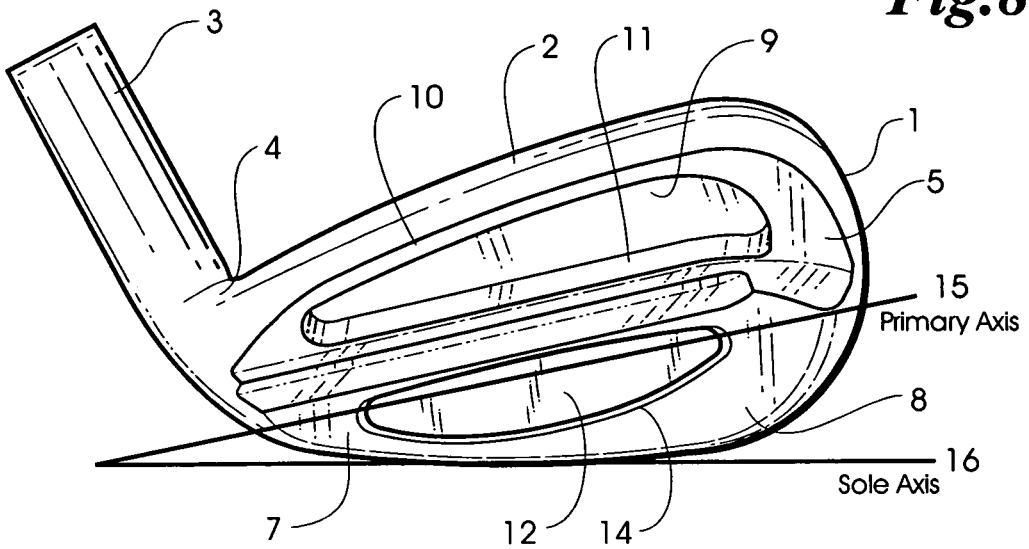
FIG. 9 is a back-side view of a golf club head, which comprises the weight adjustment member shown in FIG. 1. The term "Primary Axis" shown therein refers to the "primary longitudinal axis," as such term is used in the present specification.

In FIG. 9, for example, the club head 1 shown exhibits a substantially solid back-side near the bottom portion 8 of the club head in combination with the weight adjustment member disposed therein. In the back-side of the club head 1 near the top portion 9, however, a cavity is defined by a top rail 10 and a bottom rail 11, which runs from the heel-end 4 of the club head to its toe-end 5. Thus, as shown in FIG. 9, for example, club heads exhibiting characteristics of "cavity-backed" and "blade-type" designs can be used in connection with the weight adjustment members of the present invention.

The weight adjustment members of the present invention comprise, in one embodiment, a substantially linear back-side 25, which is disposed within a cavity 12 in the back-side 7 of the golf club head 1. The substantially linear back-side 25 of the weight adjustment members, as described and shown herein, in one embodiment, may preferably include the relative plane or contour of the back-side of such members. That is, the back-side of the members may be substantially "flat," and omit significant angles, protrusions, or like features, other than following the contour of the corresponding and adjacent portions of the back of the golf club (or, specifically, the cavity interior). In certain embodiments, the cavity 12 in which the weight adjustment members of the present invention are disposed is, preferably, positioned in such a way that the exterior surface 13 of the members is approximately adjacent to the exterior surface 14 of the back-side of the club head when the members are disposed therein.

In certain preferred embodiments, the primary longitudinal axis 15 of the cavity 12 is angled upward from the sole axis 16 to the point where the geometry of the exterior surface 13 of the member disposed therein is approximately adjacent to the exterior surface 14 of the back-side 7 of the club head 1. As discussed herein, this ability is partially facilitated by a common characteristic of conventional iron golf clubs which generally decrease in thickness as the club progresses from the sole to the top of the club, as well as from the toe to the heel of the club. The extent to which the primary longitudinal axis 15 of the cavity 12 must be angled upward from the sole axis 16 to allow the exterior surface 13 of the member disposed therein to be approximately adjacent to the exterior surface 14 of the back-side 7 of the club head, if at all, depends on the geometry of the specific club head being used. Most iron-type golf clubs, however, exhibit a certain level of consistency in their geometry as described herein.

Figure 10:
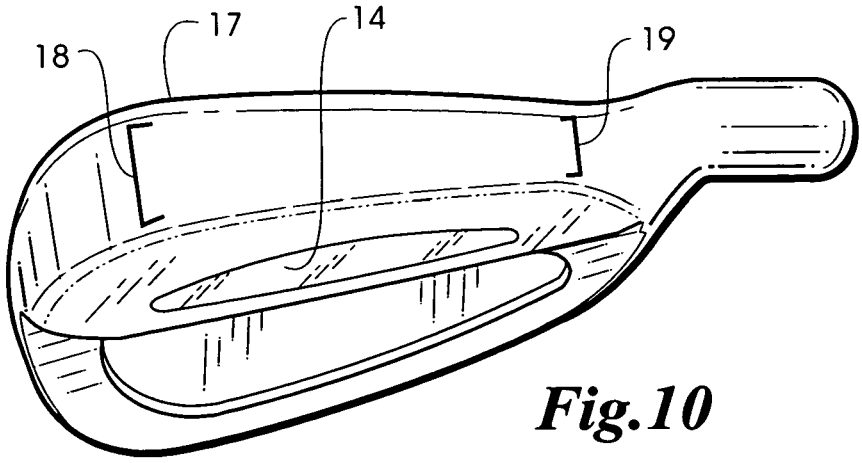
FIG. 10 is a rear elevational view of the golf club head shown in FIG. 9.

Referring to FIG. 10, for example, the soles 17 of many iron-type golf clubs are, typically, greater in width near the toe 18 of the clubs than near the heel 19. This design serves many functions including, for example, assisting in preventing or diminishing unwanted twisting movement about a vertical axis through the body of the golf club heads, which may otherwise result when the front face of the club impacts a ball near the toe or heel portions. See U.S. Pat. No. 4,621,813 to K. Solheim.

Figure 8:
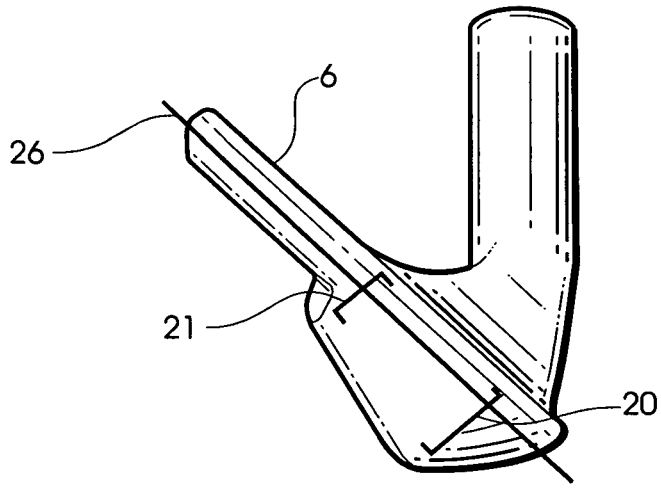
FIG. 8 is a side view (toe-end) of a golf club head.

Additionally, referring to FIG. 8, the relative width of many club heads generally increases from the top or middle portion 21 to the sole 20 along an axis 26 that is approximately parallel to the club face 6. This variation in width along the axis 26 is, typically, greater on the lower portion of the club head, including the sole 20, and diminish as the width progresses toward the top of the golf club. Indeed, some golf clubs have a relatively uniform thickness along the top of the golf club.

Accordingly, the inventors have found that when the primary longitudinal axis 15 of the cavity 12 into which the weight adjustment members are disposed is rotated counterclockwise from the sole axis 16 to a certain position, the width of the club head is approximately consistent from heel to toe along the primary longitudinal axis 15. Thus, the weight adjustment members of the present invention, which exhibit a substantially linear back-side 25 and, optionally, relatively uniform thickness 27, can be disposed in the cavity, while the exterior surface 13 of the members remains approximately adjacent to the exterior surface 14 of the back-side of the club heads.

In another, preferred embodiment, the primary longitudinal axis 15 of the cavity is preferably angled upward from the sole axis 16 to the point where the geometry of the exterior surface 13 of the member disposed therein extends beyond the back-side 7 of the golf club, or beneath the back-side 7 of the golf club, a relatively uniform distance. In such embodiments, when the primary longitudinal axis 15 of the cavity is sufficiently angled upward from the sole axis 16, the exterior surface of the weight adjustment member is approximately an equal distance across the entire member from the corresponding relative plane of the adjacent portions of the back-side of the club head when the member is disposed within the cavity. That is, the exterior surface of the weight adjustment member may, optionally, uniformly extend beyond the back-side of the club head, or, alternatively, may be uniformly depressed within the back-side of the club head across the entire member.

While the foregoing weight adjustment members may comprise a relatively uniform thickness, the present invention further contemplates that members comprising variable thickness may be employed. For example, the present invention includes members comprising an exterior surface 13 that is uniformly beveled, rounded, textured, or exhibits any other aberration or shape that may be featured on such exterior surface 13. Preferably, however, the member and its exterior surface 13 comprises a substantially symmetrical geometry. That is, while the invention does not require that the members comprise a relatively uniform thickness, it is preferred that the any variation in thickness be substantially symmetrical in relation to the approximate center of the member.

In such embodiments, of course, the relative adjacency of the exterior surface 13 of the member to the exterior surface 14 of the back-side of the club head will vary. For example, if the exterior surface 13 of the member is symmetrically convex in shape, the heel-and toe-ends of the member may be more or less adjacent to the exterior surface 14 than the center of such member. The weight adjustment members comprising variable and, preferably, symmetrical thickness (in relation to the center of the member), provide many of the same benefits described herein relating to members of relatively uniform thickness.

Because the relative width of many club heads increases from the top or middle portion 21 to the sole 20 of a golf club, the weight adjustment members of the present invention, preferably, are formed to accommodate such variation. Referring to FIG. 7, for example, the width of the top portion 23 of the member is, in one preferred embodiment, less than the width of the bottom portion 24. The weight adjustment member shown in FIGS. 6 and 7, therefore, exhibits a sloped exterior surface 13 from its top to bottom portions 23, 24.

Such designs may contribute to the ability of the members to be disposed in the cavities described herein, with the exterior surface 13 substantially adjacent, in some preferred embodiments, to the exterior surface 14 of the back-side 7 of the club head. In other embodiments described above, such designs may allow the members to be symmetrically aligned with the exterior surface 14 of the club head. That is, when the weight adjustment member is not relatively uniform in thickness, but exhibits a symmetrically configured variable thickness, the member will exhibit a correspondingly symmetrical displacement from the exterior surface 14 of the back-side 7 of the club head. In other words, the member will be symmetrically aligned across the member in relation the exterior surface 14 of the back-side 7 of the club.

Figure 6:
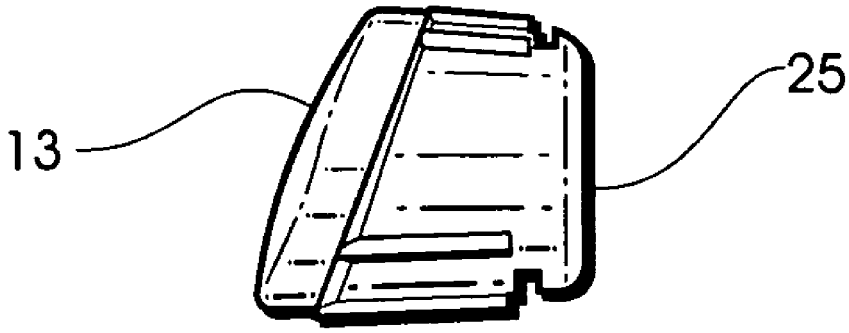
FIG. 6 is a side view (toe-end) of the weight adjustment member shown in FIG. 1.
Figure 7:
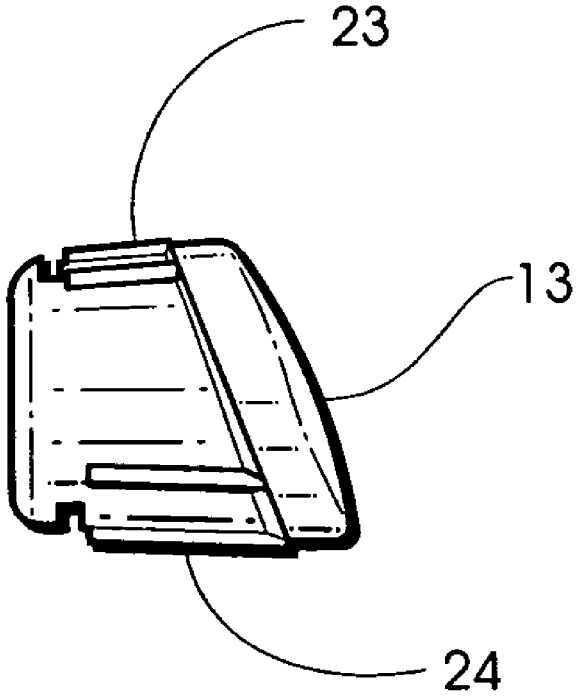
FIG. 7 is a side view (heel-end) of the weight adjustment member shown in FIG. 1.

Of course, referring to FIGS. 6–8, the extent to which the exterior surface 13 is sloped, if at all, to accommodate the progressive widths of such club heads from the top or middle portion 21 to the sole 20 may depend on several factors. For example, the degree of slope of the exterior surface 13, if any, may reflect (i) the overall geometry of the specific club heads in which each member is disposed, which will be influenced by several factors well-known in the art, (ii) the position of the member in the back-side 7 of the club head, and (iii) the internal geometry of the cavity in which each member is disposed.

In considering all of the foregoing factors, when the weight adjustment member cavities are positioned and configured as taught and described herein, the members may, preferably, exhibit a substantially linear back-side 25 and (i) a relatively uniform thickness 27 from heel- to toe-end, 28, 29 or (ii) a symmetrically configured variable thickness. As used herein, the relatively uniform thickness of the member refers to its width 27 from heel-to toe-end, 28, 29, along any point on an axis running from the top to bottom portion 23,24 of the member. That is, as describe above, due to the variation in thickness of the golf club, the exterior surface 13 of the member, preferably, may be sloped from its top to bottom portions 23, 24. Accordingly, in this embodiment, the relatively uniform thickness 27 refers to any given point along such axis running from the top to bottom portion 23,24 of the member.

There are many benefits to having weight adjustment members exhibit any of the characteristics described above, which will be readily apparent to those skilled in the art. For example, because the back-side 25 is not significantly angled and the member is relatively uniform (or symmetrically variable) in thickness, the methods and/or molds that are required to mass produce the members of the present invention are simplified.

In addition, because such members, when disposed within the cavities described herein, are, preferably, generally aligned with the geometry and contour of the golf club, the performance attributes provided by the members are, preferably, more consistent across the hitting area of the iron. That is, the weighting and vibration damping or controlling properties, for example, exhibited by the members are more consistent across the iron from heel to toe.

Moreover, because the back-side 25 is not significantly angled, the member may be positioned an approximately equal distance from the club face 6 from heel 28 to toe 29. Of course, by having the back-side 25 of the member positioned an approximately equal distance from the club face 6, a more consistent level of performance across the hitting area of the club face 6 may be achieved. In certain embodiments of the invention, the relatively uniform thickness (or symmetrically configured thickness) of the members may contribute to the more consistent level of performance across such hitting area.

The weight adjustment members of the present invention can be used in connection with a plurality of iron heads, including "blade-type" and "cavity-backed" irons. Thus, the cavity in which such members are disposed may exist in many forms. For example, in "cavity-backed" irons, a secondary cavity may be formed by an interior wall that exists within the primary cavity described above, which is formed by perimeter weighting elements in the back-side of the club head. In such case, the interior wall may, optionally, be contiguous with the sole of the club head, wherein an interior wall may extend into the primary cavity from the sole of the club head near the heel portion, through the approximate middle of the primary cavity, and terminate near the toe end of the sole to form the secondary cavity. FIG. 1 in U.S. Pat. No. 6,206,790 to D. J. Kubica et al. discloses a representative secondary cavity.

Alternatively, the interior wall may form a "stand-alone" secondary cavity, which exists within the primary cavity, but is not contiguous with any perimeter weighting element. When the weight adjustment members of the present invention are used in connection with "cavity-backed" club heads, the primary longitudinal axis of the cavity is, preferably, angled upward from the sole axis at least to the point where the exterior surface 13 of the member disposed therein is approximately adjasent to (or symmetrically aligned with) the back-side of the interior wall, which forms the cavity into which the member is disposed. Alternatively, as described above, the primary longitudinal axis of the cavity may be positioned in such a way that allows the exterior surface 13 of the member to uniformly extend beyond, or be depressed within, the back-side of the interior wall.

Figure 11:
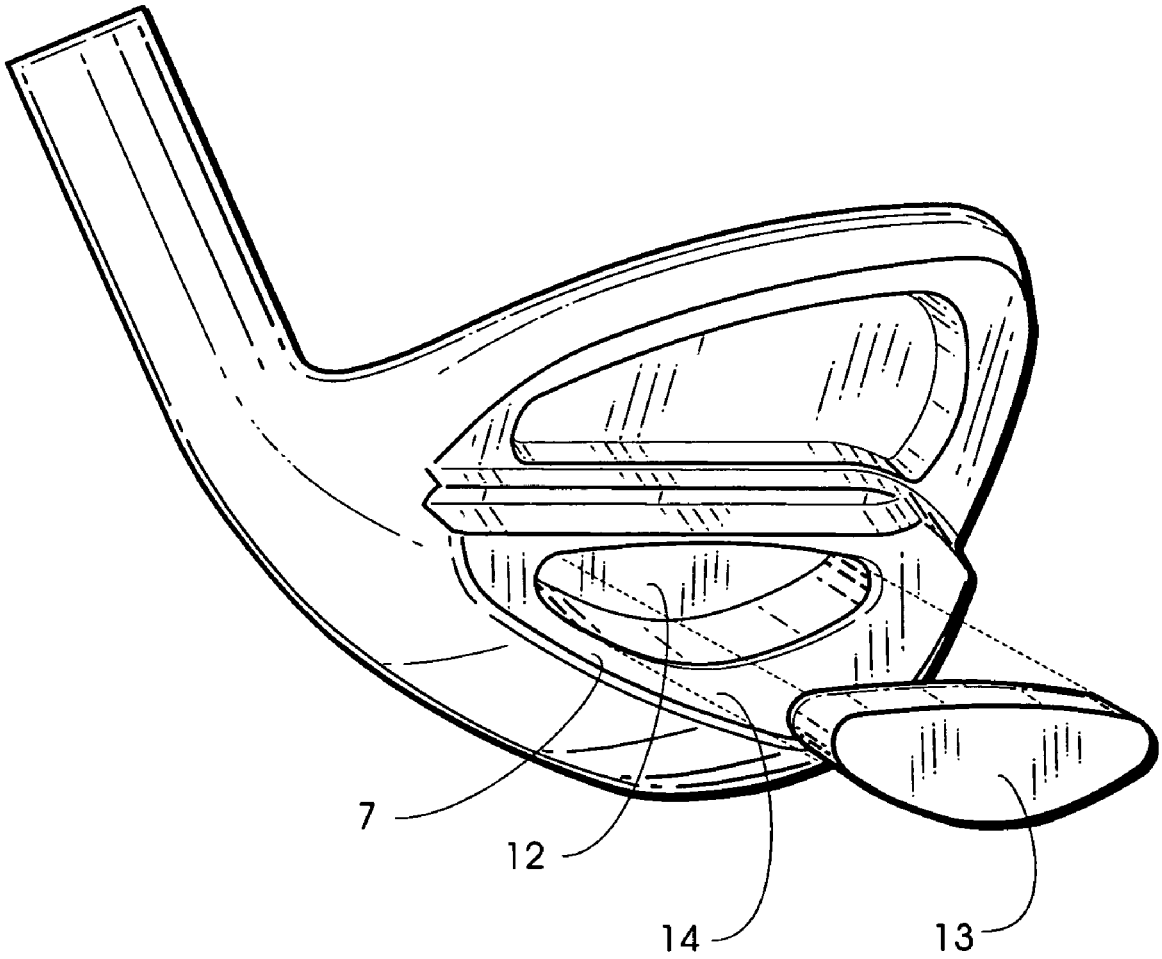
FIG. 11 is an additional back-side view of the golf club head shown in FIG. 9, which shows the cavity into which the weight adjustment member shown in FIG. 1 may be disposed.

Still further, as shown in FIGS. 9–11, the cavity into which the weight adjustment members are disposed may be "cut" into the back-side 7 of the club head. In "blade-type" club heads, for example, the cavity may exist within the substantially solid back-side 7 of the club head.

As described herein and illustrated in FIG. 9, the "primary longitudinal axis" of the cavity into which the weight adjustment members are disposed refers to an axis that transverses the cavity at its two most distant locations, i.e., it represents the "long axis" of the cavity. The "sole axis," as described herein and illustrated in FIG. 9, refers to an axis that runs approximately tangential to the sole of the club head at address.

As stated, exterior surface 13 of the weight adjustment members may, optionally, comprise any number of shapes and designs, and are not limited to those shown and described herein. More particularly, the exterior surface 13 may be, for example, slightly angled, curved, rounded, textured, etc. to provide for minor variations in club thickness and/or to create a certain aesthetic appeal. Still further, the cavity into which the members are disposed may, optionally, exhibit minor differences in depth from the exterior surface 14 of the back-side 7 of the club head from heel to toe and/or may employ certain internal geometries not described herein. Such minor variations in depth, for example, may be employed to compensate for any equally minor variations in club thickness from heel to toe along the primary longitudinal axis 15. It will be understood by those of skill in the art, however, that such minor variations in the exterior surface 13 of the members and/or internal geometry of such cavities do not remove such designs from the spirit and scope of the present invention.

Additionally, those of skill in the art will appreciate that the weight adjustment members may, optionally, exhibit a plurality of shapes and sizes to provide for the different shaped club heads that comprise a set of golf clubs. In particular, because the club heads that comprise a set of golf clubs often vary in, among other things, size, loft, and perimeter weighting, the size, shape and geometry of the weight adjustment members may be designed to accommodate for such variability in club heads in a set of golf clubs. Still further, the weight adjustment members of the present invention, preferably, exhibit a plurality of densities and weights. The weight and/or density of the weight adjustment members may be designed to affect any number of attributes of the club head, namely, swing weight, vibration absorption capacity, and center of gravity location.

The weight adjustment members of the present invention are disposed and secured within the appropriate cavity using any suitable adhesive, such as epoxy, or adhesive tape. The weight adjustment members of the present invention, preferably, exhibit grooves 22 in which excess epoxy (or other adhesive) may collect. When such grooves are employed, of course, excess adhesive, if any, is retained within the grooves and should not seep into the exterior surface 14 of the club head. Of course, the grooves that may be employed in the weight adjustment members may exhibit a plurality of shapes, sizes and designs, and are not limited to those shown and described herein.

The present invention further encompasses the novel golf club heads described herein. More particularly, invention provides novel golf club heads 1, which comprise at least one cavity in the back-side 7 of the club head, wherein the cavity is approximately equal distance from the club face 6 from its heel- to toe-end (as described above). Of course, the golf club heads of the present invention, preferably, are used in connection with at least one weight adjustment member of the present invention, which comprises the substantially linear back-side 25 described above. The golf club heads of the present invention can be made of any material known in the art to be useful in making iron-type golf clubs and, preferably, are cast or forged from a suitable metal, such as stainless steel.

In still further embodiments of the present invention, iron-type golf clubs comprising the weight adjustment members and/or club heads described herein are provided. The iron-type golf clubs of the present invention are not restricted to specific irons or the club designs shown and described herein. For example, the golf clubs of the present invention may exhibit any degree loft, which includes a 1-iron, 2-iron through any type of wedge.

The many aspects and benefits of the invention are apparent from the detailed description, and thus, it is intended for the following claims to cover all such aspects and benefits of the invention which fall within the scope and spirit of the invention. In addition, because numerous modifications and variations will be obvious and readily occur to those skilled in the art, the claims should not be construed to limit the invention to the exact construction and operation illustrated and described herein. Accordingly, all suitable modifications and equivalents should be understood to fall within the scope of the invention as claimed herein.

What is claimed is:

1. An iron-type golf club head having a heel end and a toe end, said iron-type golf club head comprising:

a front-side arranged for impact with a golf ball;

a sole axis defined by said club head resting on a horizontal surface in an address position;

a back-side with upper and lower cavities formed therein, said upper and lower cavities being separated by a generally straight rail extending from substantially adjacent said heel end to substantially adjacent said toe end, said upper cavity being generally void, said lower cavity having a primary longitudinal axis which is angled upward with respect to said sole axis and extending from a first location adjacent said heel end to a second location adjacent said toe end and having a length that is generally shorter than a length of said straight rail, said straight rail being oriented generally parallel to said primary longitudinal axis and extending rearwardly beyond the plane of said upper cavity;

a width dimension measured between said front-side and said back-side, said width dimension being substantially consistent along said primary longitudinal axis between said first and second locations; and a weight adjustment member disposed in said lower cavity, said weight adjustment member substantially filling said lower cavity and having a generally uniform thickness between said first and second locations at any point along an axis extending from a top to a bottom portion of said weight adjustment member.

* * * * *